United States Patent [19]

Purcocks

[11] 4,453,850

[45] Jun. 12, 1984

[54] SUPPORT DEVICE FOR A BINDER SYSTEM

[75] Inventor: Dale M Purcocks, Johannesburg, South Africa

[73] Assignee: Duel International Stationary Co., Ltd., Panama

[21] Appl. No.: 367,703

[22] Filed: Apr. 12, 1982

[51] Int. Cl.[3] ..... B42F 13/10; B42F 15/00

[52] U.S. Cl. ..... 402/4; 402/17; 402/63; 402/70; 402/75

[58] Field of Search ..... 402/4, 63, 70, 14–17, 402/75; 281/15 A, 15 B

[56] References Cited

U.S. PATENT DOCUMENTS 3,285,250 11/1966 Ivory et al. ..... 402/14
3,826,582 7/1974 Podosek ..... 402/4
4,180,341 12/1979 Langhorst ..... 281/45 X
4,304,499 12/1981 Purcocks ..... 402/63 X

FOREIGN PATENT DOCUMENTS 2376756 9/1978 France ..... 281/15 A

*Primary Examiner*—Paul A. Bell
*Attorney, Agent, or Firm*—Cook, Wetzel & Egan, Ltd.

[57] ABSTRACT

The invention relates to a binder system which includes as a single integral unit a support device for supporting a pair of binder strap securing means as well as suspension means, for suspending the system in either a mode of horizontal filing or lateral filing. In addition, the support device makes provision for a cover sheet to be clamped relative to the device along an edge portion thereof.

29 Claims, 6 Drawing Figures

SUPPORT DEVICE FOR A BINDER SYSTEM

This invention relates to a support device for a binder system and to a binder system including such a support device.

The applicant is aware of various binder systems which are in use today for binding together stacks of paper sheets for filing or like purposes. The systems generally include a support device, a binder strap securing means displaceably engaged with the support device and at least one binder strap which can pass through corresponding apertures in a stack of paper sheets and which can be secured relative to the support device by the strap securing means for holding a stack of paper sheets in a bound manner. In addition, binder systems often include suspension means whereby these systems can be suspended within a filing cabinet or the like. Cover sheets may also be associated with such systems so that a stack of paper sheets can be bound together between such cover sheets forming part of the binder system.

Binder systems of the above kind, known to the applicant, are all of a complex construction which is difficult to manufacture and accordingly expensive. This is particularly so when suspension means and/or cover sheets are combined with such systems in which case the support device of the system must be specially adapted and modified. The support device is in fact, usually of such a construction that suspension means and/or cover sheets cannot easily be combined therewith.

It is an object of this invention to provide a support device for a binder system which is simple in construction and which can easily accommodate the provision of suspension means for the system, and cover sheets.

According to the invention there is provided a support device for a binder system which comprises an elongate body member and which defines in cross-section along its length

- a first channel section for supporting at least one binder strap securing means;
- a second channel section for supporting suspension means for the suspension of the binder system; and
- a flange for clamping an edge portion of a cover sheet between the flange and an adjacent wall of the body member.

In a particular arrangement the flange may project from the first channel section with the second channel section being disposed along the free end of the flange. In effect, the flange therefore defines a web portion joining together the first and second channel sections.

In the above arrangement, a cover sheet may thus be clamped between the flange and an outer wall of the first channel section.

The second channel section may be adapted to locate two suspension brackets at opposite ends thereof for supporting a binder system on a pair of spaced support rails of a horizontal filing system. In particular, the suspension brackets may be slidably located within the second channel section so that they can be displaceable between a retracted inoperative position and an extended operative position in which a binder system can be suspended.

Alternatively or in addition, the second channel section may be adapted to locate a third suspension bracket intermediate between its opposite ends whereby a binder system can be suspended from a single support rail of a lateral filing system. The third suspension bracket may be pivotally located within the second channel section so that it is pivotally displaceable between a retracted inoperative position in which the entire bracket lies within the channel section and an operative position in which it projects from the channel section.

The flange and/or the adjacent wall of the body member between which a cover sheet can be clamped may include a clamping rib to penetrate a surface zone of a cover sheet during clamping to thereby improve the clamping effect of the flange.

Furthermore, the support device may be adapted so that the binder strap securing means can be pivotally supported in the first channel section to be pivotally displaceable between an unlocked position in which it can project from the support device, and a locked position where it lies within the channel section, each strap securing means having locking means for locking it in its locked position and each strap securing means having locating means for locating a binder strap thereon.

The first and/or second channel section may define lip formations projecting towards one another from opposite walls of the channel sections. The lip formations may cooperate to facilitate the location of the suspension means and binder strap securing means relative to the second and first channel sections respectively. The locking means of the strap securing means may thus also be adapted to co-operate with the lip formations of the first channel section to lock the strap securing means in its locked position.

The support device may be of a resiliently flexible material such as a synthetic plastics material. Preferably, the support device may be of a plastically deformable material such as a suitable metal material such as aluminium. The entire device may thus be formed by a single extrusion operation with few additional operations required to completely form a binder system.

The invention accordingly extends to a binder system including a support device in accordance with the invention, a pair of binder strap securing means to cooperate with the support device and a pair of binder straps, securable within the first channel section defined by the support device, by means of the strap securing means.

Each strap securing means may have a pivot zone to support the securing means pivotally in the first channel section of the support device so as to be pivotally displaceable between an unlocked position where it projects from the support device and a locked position where it lies within the channel section, each strap securing means having locking means for locking it in its locked position and each strap securing means having locating means for locating a binder strap thereon.

The locating means of the strap securing means may be an elongate groove extending along the length of the securing means and in which a binder strap is receivable. The binder strap may be locatable in the groove by a friction fit, or alternatively, the groove and the strap may include complementary formations to locate them relative to one another. The binder strap may be an elongate flexible member.

In particular, the locating means may be such that a binder strap can be threaded into the locating means but unthreading is resisted if tension is applied to the strap in an axial direction. Also, the pivot zone of each strap securing means may be provided by pivot axes slidably located in the first channel section of the support device.

The strap securing means may be moulded of a synthetic plastics material.

The binder system may further include suspension brackets located at opposite ends of the second channel section of the support device to permit the suspension of the system in a horizontal filing system.

Alternatively or in addition, the binder system may include a third suspension bracket located within the second channel section of the support device intermediate its opposite ends to permit the suspension of the binder system in a lateral filing system.

The suspension brackets may all be displaceable between an operative position in which binder systems can be suspended and an inoperative position. In particular, the suspension brackets may be displaceable in the manner hereinabove described with reference to the support device.

The binder system may additionally include a cover sheet located within the support device between the flange and an adjacent wall portion of the device.

The invention also extends to a method of forming a support device in accordance with the invention which includes the steps of extruding an elongate strip having the cross-section of a support device, and severing the strip at required lengths to provide support devices.

An embodiment of the invention is now described by way of example with reference to the accompanying drawings.

Figure 1:
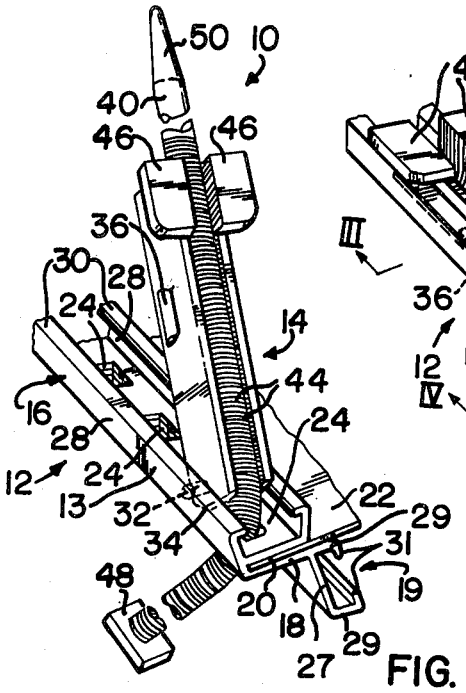
FIG. 1 shows a fragmentary, perspective view of an embodiment of a support device for a binder system in accordance with this invention, with the securing means of the binder system mounted on the support device and shown in its unlocked position.

With reference to the drawings and particularly FIGS. 1 to 4, reference numeral 10 refers generally to a part of a binder system for the storage of loose leaf computer or like sheets, not showing its suspension means.

The binder system includes a first support device 12 for supporting a pair of binder strap securing means 14 (only one being visible) in the binder system 10.

The support device 12 comprises an elongate body member 13 extruded out of a suitable aluminium alloy, having an elongated lipped first channel section body portion 16, an elongated clamping flange 18 extending integrally from the body portion 16 and an elongated lipped second channel section body portion 19 disposed along the free end of the flange 18.

Figure 4:
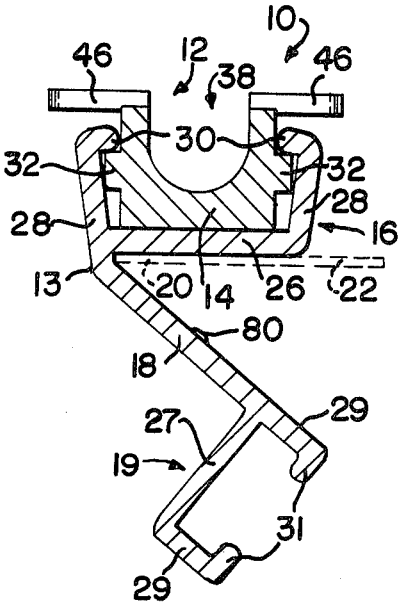
FIG. 4 shows, to an enlarged scale, a sectional fragmentary view of the binder system along line IV—IV of FIG. 2, with the support device in its extruded form as it would be prior to mounting on a cover sheet.

The support device 12 is extruded in elongated lengths in the form shown in FIG. 4 of the drawings with the clamping flange 18 extending at an angle to the body portion 16.

The elongated lengths can then be cut at spaced intervals to provide body members 13 of appropriate lengths for use.

The body member is formed out of an aluminium alloy which is plastically deformable to allow the clamping flange 18 to be displaced between its inoperative position as shown in FIG. 4 of the drawings, and a clamping position as shown in the remaining FIGS. 1 to 4 of the drawings, to clamp an edge portion 20 of a cover sheet 22 between the clamping flange 18 and the body portion 16 thereby securely locating the support device 12 on the edge portion 20 of the cover sheet 22.

The clamping flange 18 may be displaced into its clamping position in a suitable press. While so being displaced, threading apertures 24 may simultaneously be punched at spaced intervals along the length of the support device 12, through the clamping flange 18, the edge portion 20 and the base wall 26 of the body portion 16. The punching of the apertures 24 may clearly be effected at any time during the manufacturing process of the binder system 10.

The body portion 16 is further defined by the base wall 26, by a pair of opposed side walls 28, and by lip formations 30 which project inwardly from the opposed side wa11s 28. Similarly, the body portion 19 is defined by a base wall 27 projecting from the flange 18, a pair of opposed side walls 29 and lip formations 31 which project inwardly from the side walls 29.

Referring particularly to the mounting of the securing means 14 on the support device 12 and particularly the body portion 16 each binder strap securing means 14 has a pair of pivot axles 32 extending outwardly in opposed directions adjacent a pivot end 34 of the securing means 14.

The pivot axles are shaped, as can be seen particularly in FIG. 4 of the drawings, to pivotally locate each securing means 14 in the channel section of the body portion 16, with the pivot axles co-operating with the lip formations 30 to locate the securing means 14 in position.

Figure 2:
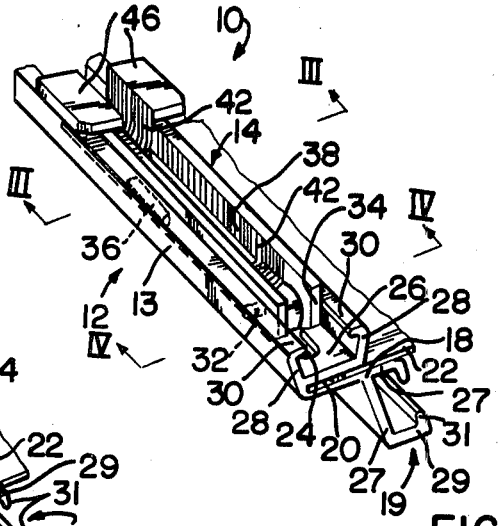
FIG. 2 shows a fragmentary, perspective view of the support device of FIG. 1, with the binder strap omitted for the sake of clarity, and with the securing means in its locked position.
Figure 3:
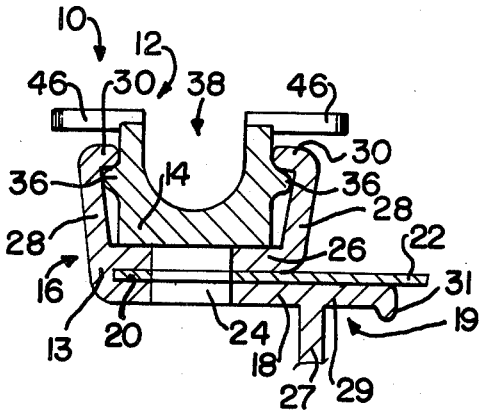
FIG. 3 shows an enlarged fragmentary, cross-sectional view of the support device along line III—III in FIG. 2.

Each securing means 14 is pivotally displaceable between its unlocked position as shown in FIG. 1 of the drawings, where it extends transversely to the length of the support device 12, and its locked position as shown in the remaining FIGS. 2 to 4 of the drawings, where it lies within the lipped channel section of the body portion 16.

Each securing means has locking means in the form of locking shoulders 36 which are shaped to co-operate with the lipped formations 30 to locate the securing means 14 in its locked position.

Each securing means 14 further includes a locating groove 38 which extends the length of the securing means 14 for removably receiving a binder strap 40 to locate the binder strap 40 on the securing means 14 during use.

Each locating groove 38 is provided with a plurality of axially spaced locating grooves 42 for co-operating with complementary locating ridges 44 provided at axially spaced intervals along the length of the binder strap 40 to locate the binder strap 40 in the locating groove 38 against axial displacement along its length.

Each locating groove 38 is defined by a pair of opposed side walls which diverge outwardly towards the base of the groove, thereby allowing the binder strap 40 to be forced into the locating groove 38, but combatting inadvertent dislodgement of the binder strap 40 from the locating groove 38.

Each securing means 14 is provided with a pair of gripping flanges 46 which can be gripped for displacing the securing means 14 into its unlocked position.

The binder system 10 further includes a pair of binder straps 40 which are moulded out of synthetic plastics material, for use with the separate securing means 14.

Each binder strap 40 has a shoulder formation 48 at its one end, and a threading formation 50 at its opposed end, and is of resiliently flexible synthetic plastics material. The formation 50 is adapted for threading through apertures 24 as is hereinafter described.

Figure 5:
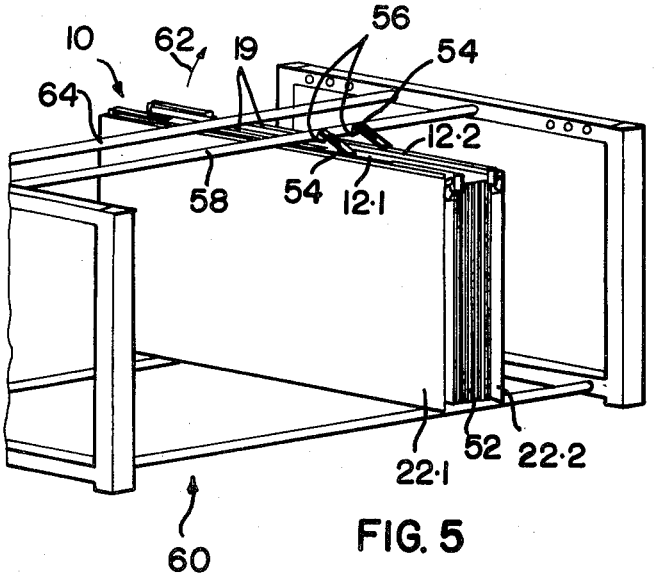
FIG. 5 shows a perspective view of a binder system, in accordance with the invention, in a first mode of suspension.
Figure 6:
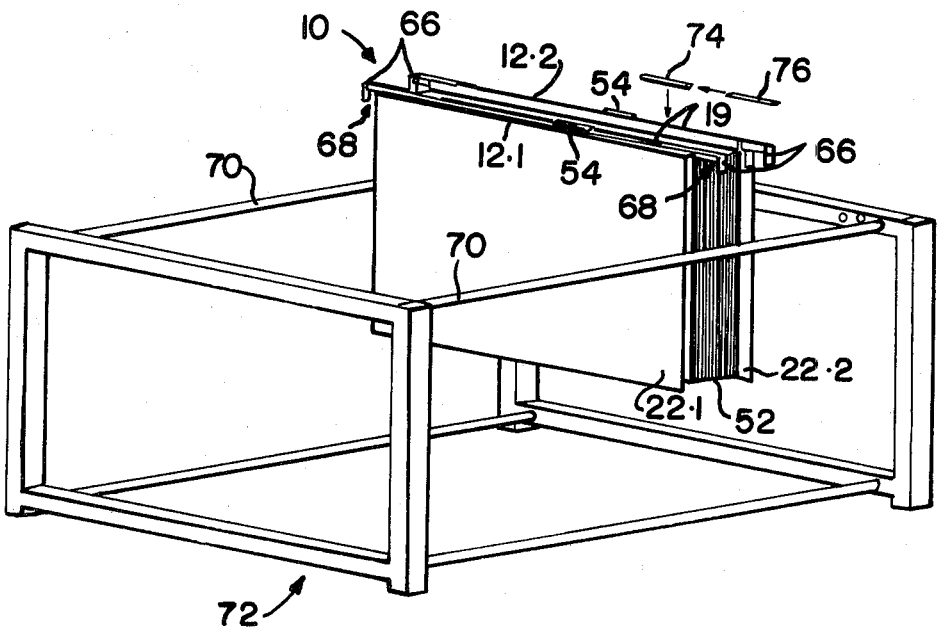
FIG. 6 shows a perspective view of the binder system of FIG. 5 in a second mode of suspension.

Referring now also to FIGS. 5 and 6 a complete binder system 10 is shown in these drawings in two operative modes of suspension. In particular, in FIG. 5, the system is shown in a mode of lateral suspension whereas in FIG. 6 the system is shown in a mode of horizontal suspension.

Referring generally to FIGS. 5 and 6, the complete binder system 10 incorporates two support devices 12.1 and 12.2 as described above. The device 12.1 may have a front cover sheet 22.1 secured thereto whereas the device 12.2 may have a rear cover sheet 22.2 secured thereto. The cover sheets 22.1 and 22.2 have score lines (not shown) provided thereon to enhance folding of the sheets into the configuration shown. Both devices 12.1 and 12.2 together with their cover sheets 22 may have apertures 24 formed therein as above described so that a binder strap 40 can be threaded therethrough.

In practice two binder straps 40 (not shown) may be threaded through apertures 24 and corresponding apertures in a pack of sheets 52 to be bound together. The binder straps 40 are first threaded through apertures 24 in the support device 12.2 until the shoulder formations 48 at one end thereof engage the base wall 26 of the device 12.2 within the channel defined by the device 12.2. The binder straps 40 are then threaded through the pack of sheets 52 and finally through the support device 12.1 which has a securing means 14 mounted thereon for engaging the binder straps 40 and binding the sheets 52 as is hereinafter described.

Referring particularly to FIG. 5, a first suspension bracket 54 is pivotally received within the channel section body portion 19 of each support device 12.1 and 12.2 intermediate their ends. In their operative configuration shown the brackets 54 project above the body portions 19 and define hook formations 56. These brackets 54 are further slightly offset from a central position between the ends of the devices 12.1 and 12.2 and can engage a suspension bar 58 of a filing system 60 by means of the hook formations 56. When so suspended the entire binding system 10 will tend to pivot in the direction of arrow 62 so that the support devices 12.1 and 12.2 engage the stop bar 64 and thus hold the entire system 10 in the suspended configuration shown.

When not in use, the brackets 54 can be pivoted to lie within the channel section body portion 19 as shown in FIG. 6 in which configuration it is completely out of the way. Pivotal axes for the brackets 54 may be defined by complementary dimple formations in the brackets 54 and side walls 29 of the channel section body portion 19.

Referring particularly to FIG. 6 opposing horizontal suspension brackets 66 are slidably received within opposite ends of the channel section body portion 19 of the support devices 12.1 and 12.2 respectively. In their operative configuration the brackets 66 extend from the devices 12.1 and 12.2 and define hook formations 68 whereby opposing suspension bars 70 of a filing system 72 can be engaged for suspending the binder system 10. When not required for use, the brackets 66 can slide into the channel section body portions 19 of the devices 12.1 and 12.2 into an inoperative configuration in which they are complete out of the way. In this configuration, the brackets lie entirely within the channel section body portions 19 as shown in FIG. 5. Complementary dimple formations (not shown) in the brackets 66 and side walls 29 of the body portion 19 may engage one another in the operative configuration of the brackets 66 thus defining the correct operative position and preventing the brackets to slide completely from the support devices 12.1 and 12.2.

The dimple formations described above may be formed into the devices 12 at any time after the extrusion of these devices by any suitable press or stamping operation.

At least one of the channel section body portions 19 of the devices 12.1 or 12.2 may also receive an identification support means 74 slidable therein whereby identification tags 76 can be located (see FIG. 6).

It will be understood that the filing systems 60 and 72 can comprise modular units adaptable for the two modes of suspension described and the invention accordingly extends to modular units for filing systems of the kind described above. These units 60, 72 may be securable to one another so that complete filing systems for any quantities of filing material can be provided.

In use, after threading of the thongs 40 as above described, and with the securing means 14 mounted on the support device 12.1 in their unlocked position, where they project normally to the length of the support device 12.1, the binder straps 40 can be forced into the locating grooves 38 where they will be clamped against inadvertent withdrawal because of the diverging shape of the side walls defining the locating grooves 38 (See FIGS. 1 to 4).

In this position the ridges 44 of the binder straps 40 will co-operate with the locating grooves 42 to locate the binder straps 40 in the locating grooves 38 against withdrawal as a result of tension applied to the binder straps 40 along their polar axes.

Thereafter, each securing means may be pivotally displaced about the pivot axles 32 into their locked positions to lock the front cover sheet 22.1 relatively to the bottom cover sheet, thereby clamping the sheets between the front and bottom cover sheets 22.1 and 22.2 respectively.

Because the pivot axles 32 are spaced from the pivot ends 34 of the securing means 14, during pivotal displacement of each securing means 14 into its locked position, tension will be applied to each binder strap 40 thereby shortening its effective length between the bottom and front cover sheets, and thereby providing a tensioned clamping action to clamp the sheets firmly in position between the front and bottom cover sheets.

To release the binder straps 40, the securing means 14 may be displaced into their unlocked positions, the binder straps may be displaced laterally out of the locking grooves 38, and the front cover sheet 22 may then be unthreaded from the binder straps 40.

It is an advantage of the embodiment of the invention as illustrated in the drawings, that the support devices 12 can be readily and effectively formed by cutting off appropriate lengths from an elongated strip of extruded aluminium alloy.

The embodiment as illustrated in the drawings provides the further advantage that since the support devices 12 are formed by extrusion out of a suitable aluminium alloy, the edges of the lip formations 30, 31 can be smoothly rounded thereby preventing these edges causing damage or injury.

The embodiment of the invention as illustrated in the drawings provides the further advantage that the support device 12 can be effectively and firmly clamped onto edge portion 20 of the cover sheets 22, and that threading apertures 24 can at the same time be provided at any desired spaced intervals along the length of the support devices 12.

It will be appreciated that, if desired, the edge portions 20 may additionally be secured to the base wall 26 and the clamping flange 18 by means of a suitable adhesive.

The embodiment as illustrated in the drawings provides the further advantage that the threading apertures can be provided at any desired intervals to suit a wide range of threading apertures provided in computer sheets, for which the system 10 is particularly useful, of various types, and that the securing means 14 can be displaced along the length of the support device 12 to utilise appropriate threading apertures.

The embodiment as illustrated in the drawings provides the further advantage that the securing means 14 can be locked and unlocked in a simple and effective manner, that the binder straps 40 can be positively located in the locating grooves 38 in a simple and effective manner, and that the binder straps 40 can be tensioned during displacement of the securing means 14 into their locked positions, thereby providing a firm clamping action for clamping computer sheets in position in the binder system 10.

It will be appreciated that, if desired, instead of the binder straps 40 as illustrated in FIG. 1, binder straps may be used having threading formations at both opposed ends. In this embodiment of the invention, it will be appreciated that support devices 12.1 and 12.2 will be provided with securing means 14 as described above.

Although the support devices are preferably of an aluminium alloy or like plastically deformable material they may also be of a resiliently flexible plastics material in which case the resilience of the plastics material permits clamping of cover sheets 22. However, particularly where binder systems 10 carry heavy loads, rigidity of the support devices 12 is essential and resilient materials not preferable.

The flange 18 and/or the adjacent wall of the body member 13 between which the cover sheets 22 are clamped may have a clamping rib 80 to penetrate a surface zone of a cover sheet during clamping to improve the clamping effect (see FIG. 4 only).

I claim:

1. A support device for a binder system which comprises an elongate body member and which defines in cross-section along its length a first channel section for supporting at least one binder strap securing means;

a second channel section for supporting suspension means for the suspension of the binder system; and a flange connecting the first channel section to the second channel section, wherein an edge portion of a cover sheet can be clamped between the first and second channel sections.

2. A support device as claimed in claim 1, in which the flange projects from the first channel section with the second channel section being disposed along the free end of the flange.

3. A support device as claimed in claim 2, in which a cover sheet can be clamped between the flange and an outer wall of the first channel section.

4. A support device as claimed in claim 1 in which the second channel section is adapted to locate two suspension brackets at opposite ends thereof for supporting a binder system on a pair of spaced support rails of a horizontal filing system.

5. A support device as claimed in claim 4, in which the suspension brackets can be slidably located within the second channel section so that they are displaceable between a retracted inoperative position and an extended operative position in which a binder system can be suspended.

6. A support device as claimed in claim 4, in which the second channel section is adapted to locate a third suspension bracket intermediate between its opposing ends whereby a binder system can be suspended from a single support rail of a lateral filing system.

7. A support device as claimed in claim 6, in which the third suspension bracket can be pivotally located within the second channel section so that it is pivotally displaceable between a retracted inoperative position in which the entire bracket lies within the channel section and an operative position in which it projects from the channel section.

8. A support device as claimed in claim 1, in which at least one of the flange and the adjacent wall of the body member between which a cover sheet can be clamped includes a clamping rib to penetrate a surface zone of a cover sheet during clamping to thereby improve the clamping effect of the flange.

9. A support device as claimed in claim 1, which is adapted to pivotally support the binder strap securing means within the first channel section so that the binder strap securing means is pivotally displaceable between an unlocked position in which it can project from the support device, and a locked position where it lies within the channel section, each strap securing means having locking means for locking it in its locked position and each strap securing means having locating means for locating a binder strap thereon.

10. A support device as claimed in claim 1, in which the second channel section defines lip formations projecting towards one another from opposite side walls of the channel section, which lip formations can co-operate to locate the suspension means relative to the second channel section.

11. A support device as claimed in claim 1, in which the first channel section defines lip formations projecting towards one another from opposite side walls of the channel section, which lip formations can co-operate to locate the binder strap securing means relative to the first channel section.

12. A support device as claimed in claim 11, in which the binder strap securing means includes a locking means which is adapted to co-operate with the lip formations of the first channel section to lock the strap securing means in a locked position relative to the device.

13. A support device as claimed in claim 1, which is of a resiliently flexible material.

14. A support device as claimed in claim 1, which is of a plastically deformable material.

15. A support device as claimed in claim 1, which is formed from an elongate extrusion cut into suitable lengths.

16. A binder system, including a support device which comprises an elongate body member and which defines in cross-section along its length a first channel section for, supporting at least one binder strap securing means, a second channel section for supporting suspension means for the suspension of the binder system, and a flange connecting the first channel section to the second channel section, wherein an edge portion of a cover sheet can be clamped between the first and second channel sections;

a pair of binder strap securing means to co-operate with the support device; and a pair of binder straps, securable within the first channel section defined by the support device, by means of the strap securing means.

17. A binder system as claimed in claim 16, in which each strap securing means has a pivot zone to support the securing means pivotally in the first channel section of the support device so as to be pivotally displaceable between an unlocked position where it projects from the support device, and a locked position in which it lies within the channel section, each strap securing means having locking means for locking it in its locked position and each strap securing means having locating means for locating a binder strap thereon.

18. A binder system as claimed in claim 17, in which the locating means of the strap securing means is an elongate groove extending along the length of the securing means and in which a binder strap is receivable.

19. A binder system as claimed in claim 18, in which the binder strap is locatable in the groove by a friction fit.

20. A binder system as claimed in claim 18 in which the binder strap and groove include complementary formations to locate them relative to one another.

21. A binder system as claimed in claim 17, in which the binder strap is in the form of an elongate flexible member.

22. A binder system as claimed in claim 17, in which the locating means is such that a binder strap can be threaded into the locating means but unthreading is resisted when tension is applied to the strap in an axial direction.

23. A binder system as claimed in claim 17, in which the pivot zone of each strap securing means is provided by pivot axes slidably located in the first channel section of the support device.

24. A binder system as claimed in claim 16, in which the strap securing means is a moulding of a synthetic plastics material.

25. A binder system as claimed in claim 16, which includes suspension brackets located at opposite ends of the second channel section of the support device to permit the suspension of the system in a horizontal filing system.

26. A binder system as claimed in claim 25, in which the suspension brackets are slidably located within the second channel section between a retracted inoperative position and an extended operative position in which the system can be suspended.

27. A binder system as claimed in claim 16, which includes a third suspension bracket located within the second channel section of the support device intermediate its opposite ends to permit the suspension of the binder system in a lateral filing system.

28. A binder system as claimed in claim 27, in which the third suspension bracket is pivotally located within the second channel section so that it is pivotally displaceable between a retracted inoperative position in which the entire bracket lies within the channel section and an operative position in which it projects from the channel section to permit suspension of the system.

29. A binder system as claimed in claim 16 which includes a cover sheet located within the support device between the flange and an adjacent wall portion of the device.

* * * * *